US007922047B2

(12) United States Patent
Gouldson

(10) Patent No.: US 7,922,047 B2
(45) Date of Patent: Apr. 12, 2011

(54) GARMENT HANGER WITH LOWER NECK STRADDLE SIZER

(75) Inventor: Stanley F. Gouldson, Northport, NY (US)

(73) Assignee: Spotless Plastics Pty. Ltd, Moorabbin, Victoria (AU)

( * ) Notice: Subject to any disclaimer, the term of this patent is extended or adjusted under 35 U.S.C. 154(b) by 0 days.

(21) Appl. No.: 12/406,501

(22) Filed: Mar. 18, 2009

(65) Prior Publication Data

US 2010/0237109 A1 Sep. 23, 2010

(51) Int. Cl.
*A41D 27/22* (2006.01)

(52) U.S. Cl. ..... 223/85; 40/322

(58) Field of Classification Search ..... 223/85, 223/DIG. 4, 88, 92, 93, 95, 96; 40/322; D6/328
See application file for complete search history.

(56) References Cited

U.S. PATENT DOCUMENTS

| | | | | |
|---|---|---|---|---|
| 4,892,237 | A * | 1/1990 | Duester et al. | 223/85 |
| 4,997,114 | A * | 3/1991 | Petrou | 223/85 |
| 5,096,101 | A * | 3/1992 | Norman et al. | 223/85 |
| 5,503,310 | A * | 4/1996 | Zuckerman et al. | 223/85 |
| 7,240,813 | B1 * | 7/2007 | Goldman | 223/88 |
| 2005/0115993 | A1 * | 6/2005 | Miura | 223/98 |
| 2006/0006204 | A1 * | 1/2006 | Mainetti | 223/85 |
| 2006/0213938 | A1 * | 9/2006 | Gouldson | 223/85 |
| 2007/0062984 | A1 * | 3/2007 | Louw | 223/85 |
| 2007/0090134 | A1 | 4/2007 | Wu | |
| 2007/0175932 | A1 | 8/2007 | Wu | |
| 2007/0199963 | A1 * | 8/2007 | Gouldson | 223/85 |
| 2007/0272716 | A1 | 11/2007 | Wu | |
| 2009/0120973 | A1 * | 5/2009 | Ho | 223/85 |
| 2009/0277933 | A1 * | 11/2009 | Goldman et al. | 223/85 |

FOREIGN PATENT DOCUMENTS

| | | |
|---|---|---|
| AU | 509043 | 6/1979 |
| DE | 203 13 340 U 1 | 12/2003 |
| GB | 2461972 A | 1/2010 |

OTHER PUBLICATIONS

United Kingdom Search Report dated Jan. 21, 2011 for Application No. GB1000818.3.

* cited by examiner

*Primary Examiner* — Gary L Welch
*Assistant Examiner* — Nathan E Durham
(74) *Attorney, Agent, or Firm* — Scully, Scott, Murphy & Presser, P.C.

(57) ABSTRACT

In a combination of an intimate apparel hanger and an indicator for displaying garment-related information, the indicator is mounted to a lower neck region of the hanger where the hanger hook intersects the hanger body. The hanger has a flange, having a sloped surface and an undersurface. The indicator has a resilient tab disposed in a wall of the indicator body. The resilient tab is outwardly displaced by the sloped surface to expand the top opening of the indicator to allow the indicator to pass over the flange. The undersurface of the flange retains the indicator at the lower neck region after the indicator passes over the flange.

16 Claims, 4 Drawing Sheets

GARMENT HANGER WITH LOWER NECK STRADDLE SIZER

BACKGROUND OF THE INVENTION

1. Field of Invention

The present invention relates generally to the field of garment hangers as are widely used for the purpose of shipping and displaying garments, and more particularly to a combination of a plastic molded garment hanger, such as an intimate apparel hanger, and a size indicator attached to the hanger at a lower neck region of the hanger.

2. Description of Related Art

In the area of retail garment sales, so-called Garment-On-Hanger (GOH) programs have become preferred by retailers. In a GOH program, garments are delivered to retail merchants already suspended from hangers, where upon arrival at the retail location the garments are immediately placed on display for sale.

In particular, retailers have specified particular hangers or hanger characteristics among suppliers in order to achieve uniformity on their sales floors. To this end, standards as to hanger size, shape, performance characteristics, etc., are maintained, for example, by organizations such as the Voluntary Inter-industry Commerce Standards Association (VICS). Intimate apparel hangers, pinch grip hangers, top garment hangers and so on are among the standardized hangers under the VICS standards.

Additionally, and interrelated to the promulgation of GOH programs, retailers and their customers desire to have the hanger itself display some indicia regarding the item carried upon it. Categories of indicia include manufacturer, material and price, but mostly the sizes of garments. Among the various means developed for accomplishing this, so-called lower neck indicators are widely applied and recognized in the industry. Lower neck indicators are secured to the hanger at or adjacent the intersection of the hook and the hanger body, to provide a displaying surface on which garment sizes are printed.

Normally, the lower neck indicators are secured to the hangers, either manually or automatically, at the manufacturers' cost. Thus, it is desirable in the industry to easily and quickly attach the indicators to the hangers. Accordingly, assembling efficiency can be improved and manufacturing cost of the hangers and the indicators can be reduced, which in turn offers a significant commercial advantage to the manufacturers, transporters, as well as retailers in the industry.

At the same time, it is also desirable in the industry to securely attach the indicators to the hangers. The reliable affixation of the indicators to the hangers in the GOH program prevents the indicators from accidentally and unintentionally moving and subsequently detaching from the hangers. Specifically, under industry standards, such as the VICS, it is required to maintain a certain degree of affixation of the indicator to the hanger to avoid young children from swallowing an indicator after the indicator is accidentally detached from a hanger, so as to provide so-called "child proof" hangers.

Accordingly, there is a need for improved garment hanger and indicator, which, in combination, enable easy and quick attachment of the indicator to the hanger while stilt maintaining a secure fixation of the indicator onto the hanger.

BRIEF SUMMARY OF THE INVENTION

Therefore, in order to overcome certain deficiencies of the prior art, provided according to one aspect of the present invention is a combination of an garment hanger and an indicator for displaying garment-related information. The hanger includes a hanger body and a hook extending upward from the body. The intersection of the hook and the hanger body defines a lower neck region of the hanger where the indicator is attached to the hanger. The hanger further includes at least a first flange projecting from the hook at a position distanced upward from the body of the hanger. The first flange includes a first sloped surface extending downward and away from the hook and a first undersurface extending away from the hook. The indicator is positioned at the lower neck region below the first undersurface of the first flange. The indicator includes an indicator body substantially surrounding the hook, and a top opening and a bottom opening defined at the top side and bottom side of the indicator, respectively. Specifically, the first undersurface of the first flange provides indicator-retaining interference with the indicator to retain the indicator at the lower neck region.

According to one embodiment of the present invention, the indicator body includes a pair of opposing side walls connected by a pair of opposing end walls to provide a substantially trapezoidal profile of the indicator. The indicator further includes at least a first resilient tab formed at the upper side of either a side wall or an end wall. The first resilient tab is defined by a first pair of slots substantially bounding the sides of the first tab.

Preferably, the first resilient tab includes a first free upper end configured to engage the first sloped surface of the first flange to enlarge the top opening of the indicator to allow the indicator to pass over the first flange. The first free upper end is also configured to engage the first undersurface of the first flange once the indicator has passed over the first flange to retain the indicator at the lower neck region of the hanger.

Preferably, the first undersurface of the first flange is substantially horizontal. More preferably, the indicator farther includes a first horizontal lip extending inwardly from the first resilient tab at the first free upper end, the first lip configured to engage the first sloped surface of the first flange to enlarge the top opening of the indicator to allow the indicator to pass over the first flange and to engage the first undersurface of the first flange once the indicator has passed over the first flange to retain the indicator at the lower neck region of the hanger.

According to another embodiment of the present invention, the hanger further includes a second flange projecting from the hook at a position distanced upward from the body of the hanger and opposite to the first flange. The second flange includes a second sloped surface extending downward and away from the hook and a second undersurface extending away from the hook. The indicator further includes a second resilient tab opposite the first resilient tab. The second resilient tab is formed at the upper side of either a side wall or an end wall opposite the first resilient tab, and the second resilient tab is defined by a second pair of slots substantially bounding the sides of the second tab.

Preferably, the second resilient tab includes a second free upper end configured to engage the second sloped surface of the second flange to enlarge the top opening of the indicator to allow the indicator to pass over the second flange. The second free upper end is also configured to engage the second undersurface of the second flange once the indicator has passed over the second flange to retain the indicator at the lower neck region of the hanger.

Preferably, the second undersurface of the second flange is substantially horizontal. More preferably, the indicator father includes a second horizontal lip extending inwardly from the second resilient tab at the second free upper end. The second lip is configured to engage the second sloped surface of the second flange to enlarge the top opening of the indicator to allow the indicator to pass over the second flange and to engage the second undersurface of the second flange once the indicator has passed over the second flange to retain the indicator at the lower neck region of the hanger.

According to yet another embodiment of the present invention, the hanger further includes a third flange disposed under the first flange, and configured to be enclosed by the body of the indicator once the indicator has passed over the first flange. The third flange includes a third sloped surface extending downward and away from the hook. The third sloped surface of the third flange is configured to engage the interior of the first resilient tab, thereby preventing the indicator from moving horizontally against the third flange. Preferably, the third sloped surface of the third flange is configured to be complementary to the interior of the first resilient tab. More preferably, the inclination of the third sloped surface relative to a horizontal plane is substantially equal to the inclination of the first resilient tab relative to the horizontal plane.

Preferably, the indicator further includes a pair of notches formed at the lower ends of the end walls, respectively. The notches are dimensioned to be substantially complementary to the width of the hanger body to at least partially accommodate the hanger body, thereby preventing the indicator from moving laterally.

Preferably, the hook and the hanger body are integrally molded through a single plastic molding process.

Preferably, the flanges of the hook are integrally molded with the hook through a single plastic molding process.

Preferably, the hook and the hanger body form an acute angle at one side of the hook and an obtuse angle at the other side of the hook.

Preferably, the hanger body includes a first arm extending from the hook to a first end of the hanger body and a second arm extending from the hook to a second end of the hanger body. More preferably, the hanger further includes at least a first garment clip disposed at the first end of the hanger body and at least a second garment clip disposed at the second end of the hanger. The first garment clip and the second garment clip retain at least a part of a garment. More preferably, the first garment clip and the second garment clip are composite garment clips including a vertical garment retaining clip, a lower horizontal garment retaining clip and an upper horizontal garment retaining clip.

According to another aspect of the present invention, provided is a garment hanger, specifically an intimate apparel hanger. The hanger includes a hanger body and a hook extending upward from the body. The intersection of the hook and the hanger body defines a lower neck region of the hanger where an indicator is attached to the hanger. The hanger further includes at least a first flange projecting from the hook at a position distanced upward from the body of the hanger. The first flange includes a first sloped surface extending downward and away from the hook and a first undersurface extending away from the hook. The first undersurface of the first flange provides indicator-retaining interference with the indicator to retain the indicator at the lower neck region. Preferably, the first undersurface of the first flange is substantially horizontal.

According to another embodiment of the present invention, the hanger further includes a second flange projecting from the hook at a position distanced upward from the body of the hanger and opposite to the first flange. The second flange includes a second sloped surface extending downward and away from the hook and a second undersurface extending away from the hook. Preferably, the second undersurface of the second flange is substantially horizontal.

According to yet another embodiment of the present invention, the hanger further includes a third flange disposed lower than the first undersurface of the first flange. The third flange includes a third sloped surface extending downward and away from the hook, for engaging an interior of an indicator.

Preferably, the hook and the hanger body are integrally molded through a single plastic molding process.

Preferably, the hook and the hanger body form an acute angle at one side of the hook and an obtuse angle at the other side of the hook.

According to another aspect of the present invention, provided is a size indicator attached to a lower neck region of a hanger for displaying garment-related information. The indicator includes a pair of opposing side walls connected by a pair of opposing end walls to provide a substantially trapezoidal indicator body substantially surrounding a hook of the hanger. The indicator further includes a top opening and a bottom opening defined by the side walls and end walls, at the top side and the bottom side of the indicator, respectively. The indicator further includes a pair of resilient tabs formed at the upper sides of the either the side walls or the end walls. Each of the resilient tabs is defined by a pair of elongated slots substantially bounding the sides of the resilient tabs. The resilient tabs each comprise a free upper end displaceable to enlarge the top opening of the indicator to allow the indicator to pass over the hook of the hanger. The indicator further includes a pair of notches formed at the lower ends of the end walls, respectively, the notches dimensioned to be substantially complementary to the width of the hanger body.

Preferably, the top opening and the bottom opening are substantially defined at horizontal planes.

Preferably, the pair of resilient tabs each comprise a horizontal lip extending inwardly from the free upper ends of the resilient tab.

BRIEF DESCRIPTION OF THE DRAWINGS

These and other features, aspects and benefits of the present invention will be made apparent with reference to the following specification and accompanying drawings, where like reference numerals refer to like features across the several views, and wherein.

DETAILED DESCRIPTION OF THE INVENTION

Figure 1:
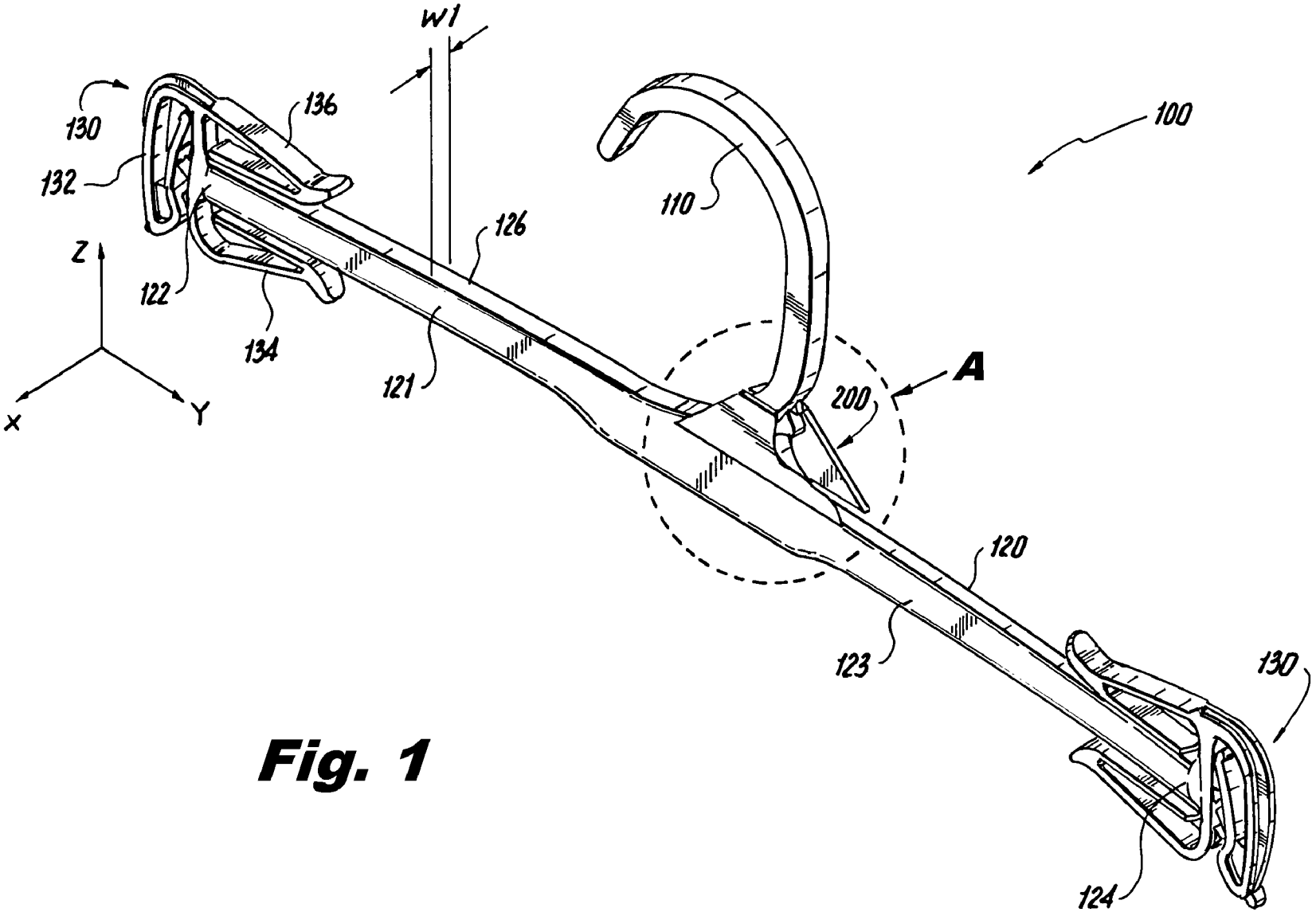
FIG. 1 illustrates a perspective of a combination of a garment hanger, such as an intimate apparel hanger, and an indicator, according to an exemplary embodiment of the present invention.
Figure 2:
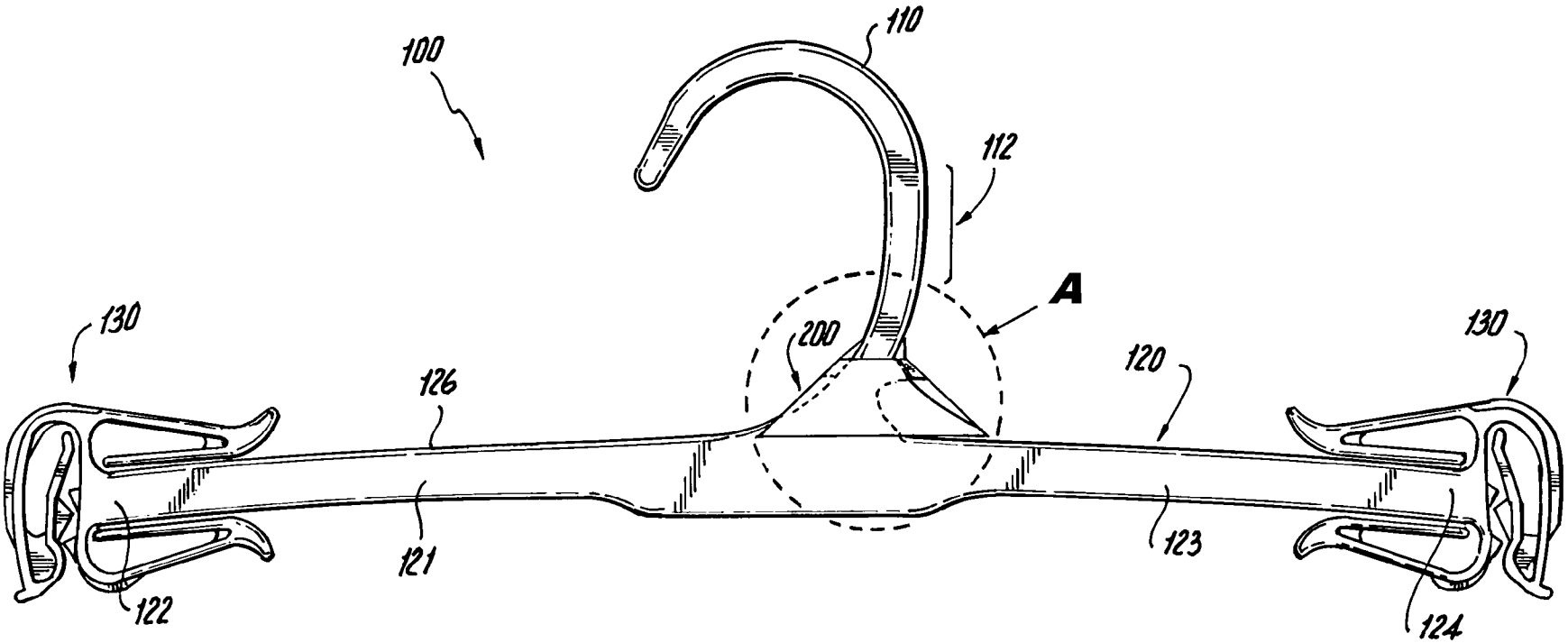
FIG. 2 illustrates a front elevation view of the combined shown in FIG. 1.

Referring now to FIGS. 1 and 2, illustrated is a combination of an intimate apparel hanger 100 and a lower neck indicator 200 attached to the hanger 100 for showing information related to a garment suspended by the hanger 100, such as the size of the garment.

The hanger 100 includes a hook 110 and a hanger body 120 connected to the hook 100. Preferably, the hook 110 is integrally molded to the hanger body 120 through a single plastic molding step. The intersection of the hook 110 and the hanger body 120 defines a lower neck region A, shown in FIGS. 1 and 2, where the indicator 200 is attached to the hanger 100. The hook 110 includes a substantially vertical part 112 above the lower neck region A, as shown in FIG. 2. The hanger body 120 can have any suitable configuration, such as a C-section beam, a reversed U-section beam, and so on.

The hanger body 120 includes a first arm 121 extending from the hook 110 to a first end 122 of the hanger body 120, and a second arm 123 extending oppositely from the hook 110 to a second end 124 of the hanger body 120. Preferably, the first arm 121 and the second arm 123 are substantially horizontal to provide a straight and elongated hanger body.

The hanger 100 further includes a pair of composite garment retaining clips 130 disposed at the first end 122 and the second end 124 of the hanger body 120, respectively. The composite clips 130 can assume any configuration suitable for retaining intimate apparel. In the shown embodiment, the clips 130 include a vertical garment retaining clip 132, attached to an end 122 of the body 120. The clips 130 further include a lower garment retaining clip 134, extending inwardly under the body 120 from the end 122 toward the hook 110, and an upper garment retaining clip 136, extending inwardly above the body 120 from the end 122 toward the hook 110.

In FIG. 1, a three-dimensional coordinate system is defined as shown. The hook 110 extends upward from the hanger body 120, substantially along the vertical Z-axis of the coordinate system. The hanger body 120 extends substantially along the horizontal Y-axis of the coordinate system to define a length of the hanger body 120 between the opposite ends 122 of the hanger body 120. Furthermore, along the lateral X-axis of the coordinate system, a first width W1 of the hanger body 120 is defined as the width of an upper surface 126 of the hanger body 120.

Figure 3:
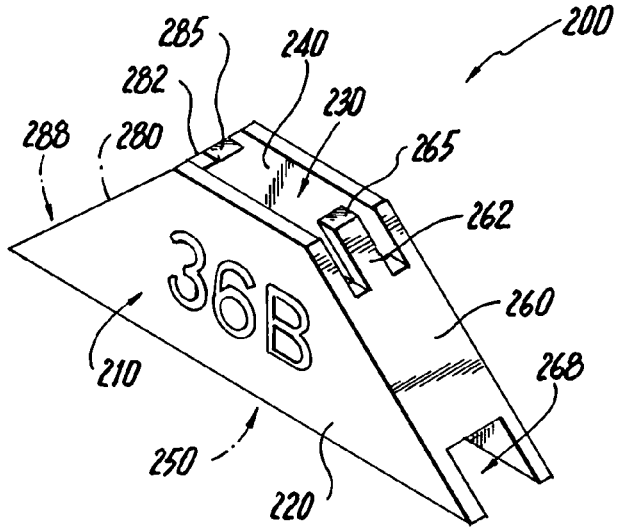
FIG. 3 illustrates a perspective view of the lower neck indicator shown in FIG. 1.

FIGS. 3-6 illustrate the structural details of the lower neck indicator 200. As shown in FIG. 3, the indicator 200 includes an indicator body 210, which substantially surrounds the hook 110 when the indicator 200 is attached to the hanger 100 at the lower neck region A. The indicator 200 further includes a top opening 230 and a bottom opening 250, formed at the top side and bottom side of the indicator 200, respectively. During the process of attaching the indicator 200 to the hanger 100 at the lower neck region A, the indicator 200 passes over the hook 110 through the top opening 230 and the bottom opening 250, and subsequently sits on the upper surface 126 of the hanger body 120. Preferably, the bottom opening 250 is larger than the top opening 230, and the top opening 230 of the indicator 200 is suitably dimensioned to allow the indicator 200 to pass over the hook 110 while providing certain interference with the hook 110 and/or any peripheral structures of the hook 110.

In the shown embodiment, the indicator body 210 includes an anterior side wall 220 and an opposite posterior side wall 240. The indictor 210 further includes a right end wall 260 and a left end wall 280, connecting the anterior side wall 220 and the posterior side wall 240 to form a continuous structure for the indicator body 210 to surround the hook 110 of the hanger 100.

Figure 4:
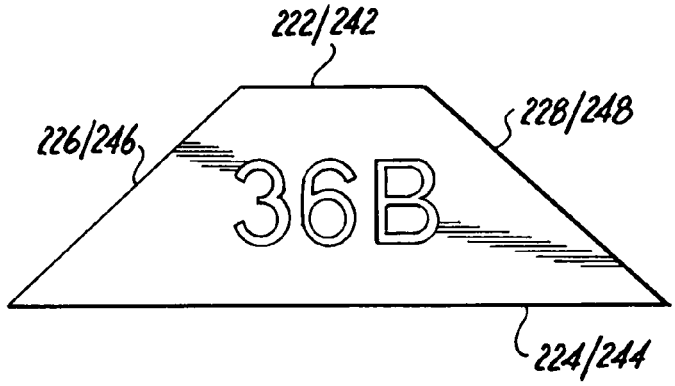
FIG. 4 illustrated a front elevation view of the indicator in FIG. 3.

As best shown in FIG. 4 illustrating a front elevation view of the indicator 200, the anterior side wall 220 and the posterior side wall 240 are substantially trapezoidal, to provide a substantially trapezoidal profile for the indicator 200. The anterior wall 220 and the posterior wall 240 are geometrically equal and symmetrical to one another. Thus, in the shown view, the sides of the anterior wall 220 and corresponding sides of the posterior wall 240 are overlapped.

The anterior side wall 220 includes substantially parallel upper side 222 and lower side 224, and a pair of slanted sides 226 and 228. Symmetrically, the posterior side wall 240 includes substantially parallel upper side 242 and lower side 244, and a pair of slanted sides 246 and 248. The trapezoidal profile of the indicator 200 provides a large displaying area.

The top opening 230 and the bottom opening 250 of the indicator 200, shown in FIG. 3, are substantially defined by the sidewalls 224 and 240 and the end walls 260 and 280, at the top side and bottom side of the indicator 200, respectively. The upper side 222 of the anterior side wall 220 and the upper side 242 of the posterior side wall 240 are substantially in the same plane of the top opening 230.

Figure 5:
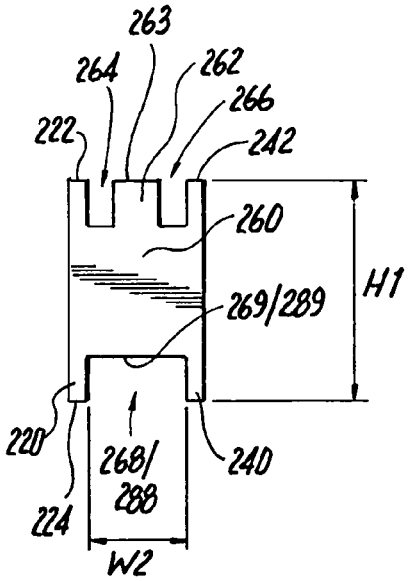
FIG. 5 illustrates a side view of the indicator in FIG. 3.

FIG. 5 illustrates a side view of the indicator 200 from the right end wall 260. The right end wall 260, connecting the anterior side wall 220 and the posterior side wall 240, includes a first resilient tab 262 substantially in a finger-like shape. The first resilient tab 262 terminates in a first free upper end 263, which is substantially in the same plane as the top opening 230 of the indicator 200. The first resilient tab 262 is defined and bounded by a first pair of slots 264 and 266, at the lateral sides of the right end wall 260, respectively. The first pair of slots 264 and 266 are substantially elongated slots parallel to one another, extending downwardly from the plane of the top opening 230 of the indicator.

The construction of the first pair of slots 264 and 266 bounding the first resilient tab 262 provides the first resilient tab 262 the ability to deflect outwardly to enlarge the top opening 230 under a biasing force and return inwardly to its original position when the bias force is withdrawn.

Although the above embodiment has been described with respect to a resilient tab formed in an end wall, it is understood by one of ordinary skill in the art that the resilient tab can be formed in a side wall instead of the end wall or in both the side wall and the end wall, depending on specific requirements and application circumstances of the indicator.

Figure 6:
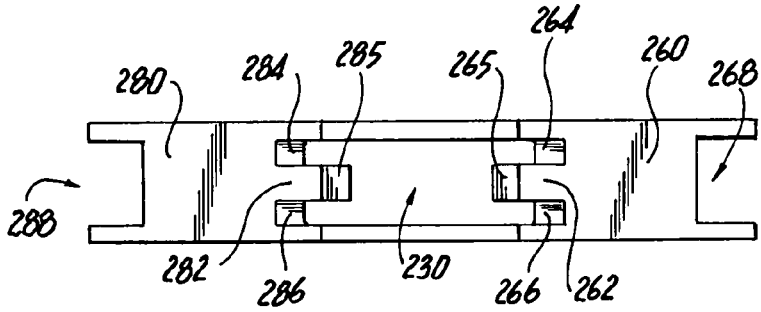
FIG. 6 illustrates a top view of the indicator in FIG. 3.

FIG. 6 illustrates a top view of the indicator 200. As shown in FIGS. 3 and 6, the indicator 200 further includes a second resilient tab 282 formed in the left end wall 280 of the indicator. The second resilient tab 282 is opposite to the first resilient tab 262 and substantially symmetrical to the first resilient tab 262.

The second resilient tab 282 terminates in a second free upper end 283, which is also substantially in the same plane as the top opening 230 of the indicator 200. The second resilient tab 282 is defined and bounded by a second pair of slots 284 and 286, at the lateral sides of the left end wall 280, respectively. The second pair of slots 284 and 286 are substantially elongated slots parallel to one another, extending downwardly from the plane of the top opening 230 of the indicator 200.

The construction of the second pair of slots 284 and 286 bounding the second resilient tab 282 provides the second resilient tab 282 the ability to deflect outwardly to further enlarge the top opening 230 under a biasing force and return inwardly to its original position when the bias force is withdrawn.

Accordingly, by deflecting outwardly the first resilient tab 262 and the second resilient tab 282 simultaneously, the top opening 230 of the indicator 200 can be enlarged to allow the indictor to pass over the hanger hook 110 and any peripheral structure of the hook 110.

As illustrated in FIGS. 3, 5 and 6, the indicator 200 further includes a first notch 268 below the right end wall 260 and a second notch 288 below the left end wall 280. The first notch 268 and the second notch 288 are in the form of a carve-out, extending upwardly from the lower side 224 of the anterior side wall 220 and the lower side 244 of the posterior side wall 240.

Preferably, the first notch 268 and second notch 288 are equal in their dimensions, having a second width W2 as shown in FIG. 5. The second width W2 is substantially equal to the first width W1 of the hanger body shown in FIG. 1. Thus, once the indicator 200 passes over the hook 110 of the hanger 100 to be positioned on the hanger body 120, the indicator 200 straddles on the hanger body 120, with the anterior side wall 220 and the posterior side wall 240 extending at either side of the hanger body 120. The straddling action of the indicator 200 on the hanger body 120 prevents the indicator 200 from moving laterally along the X direction, to provide a secure attachment of the indicator 200 to the hanger 100.

Furthermore, a first height H1 is defined for the indicator 200, as shown in FIG. 5, from the upper side 222 of the anterior side wall 220 and the upper side 242 of the posterior side wall 240 to the upper side 269 of the first notch 268 and the upper side 289 of the second notch 288.

Figure 8:
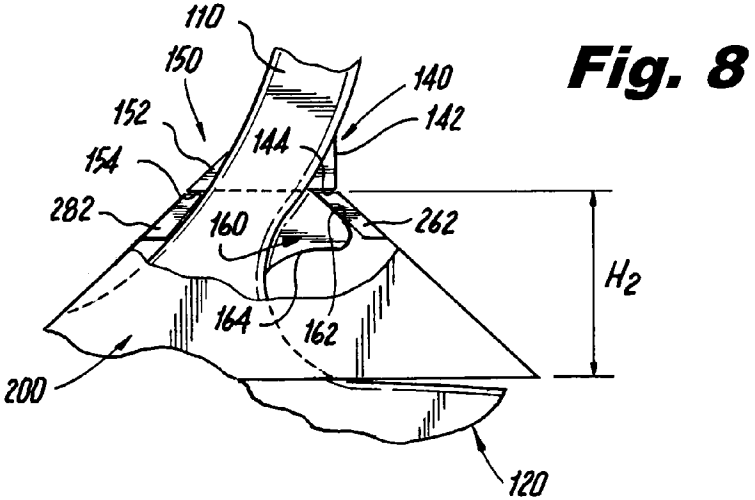
FIG. 8 illustrated an enlarged front elevation view of the combination shown in FIG. 7.
Figure 7:
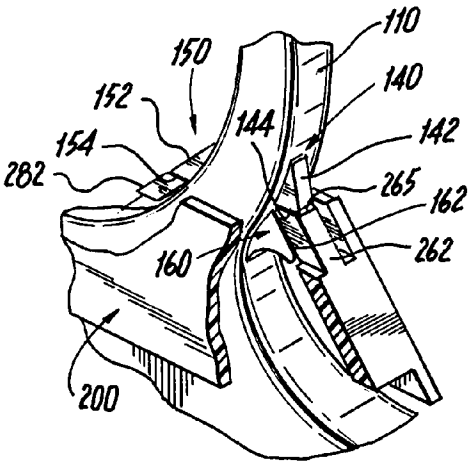
FIG. 7 illustrates an enlarged perspective of the combination in FIG. 1, at the lower neck region of the hanger indicated by the circle A in FIG. 1.

Referring to FIGS. 7 and 8, illustrating enlarged views of the combination of the hanger hook 110 and the indicator 200 at the lower neck region A, a detailed description of the mounting structure of the hanger 100 and the attachment of the indicator 200 to the hanger 100 will be made.

The hanger 100 includes a first flange 140 formed at the lower neck region A. The first flange 140 is dimensioned and configured to operatively engage and displace the first resilient tab 262 of the indicator 200, thereby enlarging the top opening 230 of the indicator 200 to allow the indicator 200 to pass over the first flange 140 and consequently retaining the indicator 200 at the lower neck region A.

Specifically, the first flange 140 is disposed to project from the hook 110 at a position distanced upward from the hanger body 120. The first flange 140 includes a first sloped surface 142 extending downward and away from the hook 110 and a first undersurface 144 extending away from the hook 110. The first sloped surface 142 is sloped with respect to the outer profile of the hook 110. During operation, when the indicator 200 passes over the substantially vertical part 112 of the hook 110 and approaches the lower neck region A of the hanger 100, the first resilient tab 262 comes into engagement with the first sloped surface 142. The interaction between the first sloped surface 142 and the first resilient tab 262 expands the top opening 230 of the indicator 200 by outwardly deflecting the resilient tab 262. With the expansion of the top opening 230, the indicator 200 continues to move downwardly until it passes over the sloped surface 142 of the first flange 142. Specifically, during operation, the first free upper ends 263 of the first resilient tab 262 slides on the first sloped surface 142 to activate an outward deflection of the resilient tab 262. The first free upper end 263 flares out to enlarge the top opening 230 of the indicator 200.

Preferably, the sloped surface 142 is dimensioned and configured to follow the curvature of the hook 110 at the lower neck region A, thereby providing a smooth profile for flexing the resilient tab 262.

Once the first resilient tab 262 passes over the sloped surface 142, the tab returns to its original position, due to the resilience of the tab. Accordingly, the first resilient tab 262 comes into contact with the first undersurface 144 of the first flange 140. The first undersurface 144 provides indicator-retaining interference with the indicator 200 to retain the indicator at the lower neck region A of the hanger 100. Specifically, the first undersurface 144 serves as a retaining surface, holding the first resilient tab 162 under the first flange 140 and preventing the indicator 200 from moving upwardly along the Z direction.

The first undersurface 144 can assume any suitable configuration, such a curved surface or stepped surface, within the scope of the present invention, as long as it functions to hold the indicator 200 in the lower neck region A. Preferably, the first undersurface 144 is substantially horizontal. Preferably, referring back to FIGS. 3 and 6, the indicator 200 further includes a first horizontal lip 265 extending substantially horizontally from the first resilient tab 262 at the first free upper end 263 of the resilient tab 262. The first horizontal lip 265 engages the first sloped surface 142 of the first flange 140 to enlarge the top opening 230 of the indicator and subsequently engages the first undersurface 144 to retain the indicator 200 at the lower neck region A of the hanger 100. Specifically, the first horizontal lip 265 provides a complementary structure to a horizontal first undersurface 144, to offer the advantage of securely retaining in the indicator 200 at the lower neck region A.

The hanger 100 further includes a second flange 150, disposed oppositely to the first flange 140 and cooperates with the second resilient tab 282 of the indicator 200. Similarly, the second flange 150 projects from the hook 110 at a position distanced upward from the hanger body 120, at substantially the same height of the first flange 140.

The second flange 150 includes a second sloped surface 152 extending downward and away from the hook 110 and a second undersurface 154 extending away from the hook 110. The structural characterization and function of the second sloped surface 152 and the second undersurface 154 of the second flange 150 are similar to those of the first flange 140, and the description thereof is omitted for brevity.

Preferably, the second undersurface 154 is substantially horizontal. Preferably, referring back to FIGS. 3 and 6, the indicator 200 further includes a second horizontal lip 285 extending substantially horizontally from the second resilient tab 282 at the second free upper end 283. The second horizontal lip 285 engages the second sloped surface 152 of the second flange 150 to enlarge the top opening 230 of the indicator and subsequently engages the second undersurface 154 to retain the indicator 200 at the lower neck region A of the hanger 100. Specifically, the second horizontal lip 285 provides a complementary structure to a horizontal second undersurface 154, to offer the advantage of securely retaining the indicator 200 at the lower neck region.

Preferably, the first flange 140 and the second flange 150 are distanced from the hanger body 110 by a second height H2, defined from the first undersurface 144 and the second undersurface 154 to an upper surface 120 (FIG. 2) of the hanger body 110. Preferably, the second height H2 is substantially equal to the first height H1 of the indicator 200, as shown in FIG. 5. Thus, once the indicator 200 straddles on the hanger body 120, the indicator is substantially sandwiched by the flanges 140 and 150 and the hanger body 120. Accordingly, the movement of the indicator 200 along the vertical direction is prevented.

As shown in FIGS. 7 and 8, the hanger 100 further includes a third flange 160 disposed below the first flange 140, opposite to the first flange 140 along the vertical direction. The third flange 160 is configured to be substantially enclosed by the walls of the indicator 200, to prevent the indicator 200 from moving horizontally against the third flange 160, along the Y direction.

The third flange 160 includes a third sloped surface 162 extending downward and away from the hook 110. Preferably, the third sloped surface 162 is complementary to an interior of the indicator 200, specifically the inner side of the first resilient tab 262. More preferably, the third sloped surface 162 conforms to the inclination of the first resilient tab 262 and the right end wall 260 of the indicator 200, to maximize the contact and engagement between the first resilient tab 262 and the third sloped surface 162. Thus, the horizontal movement of the indicator 200 against the third flange 160 is prevented.

Figure 9:
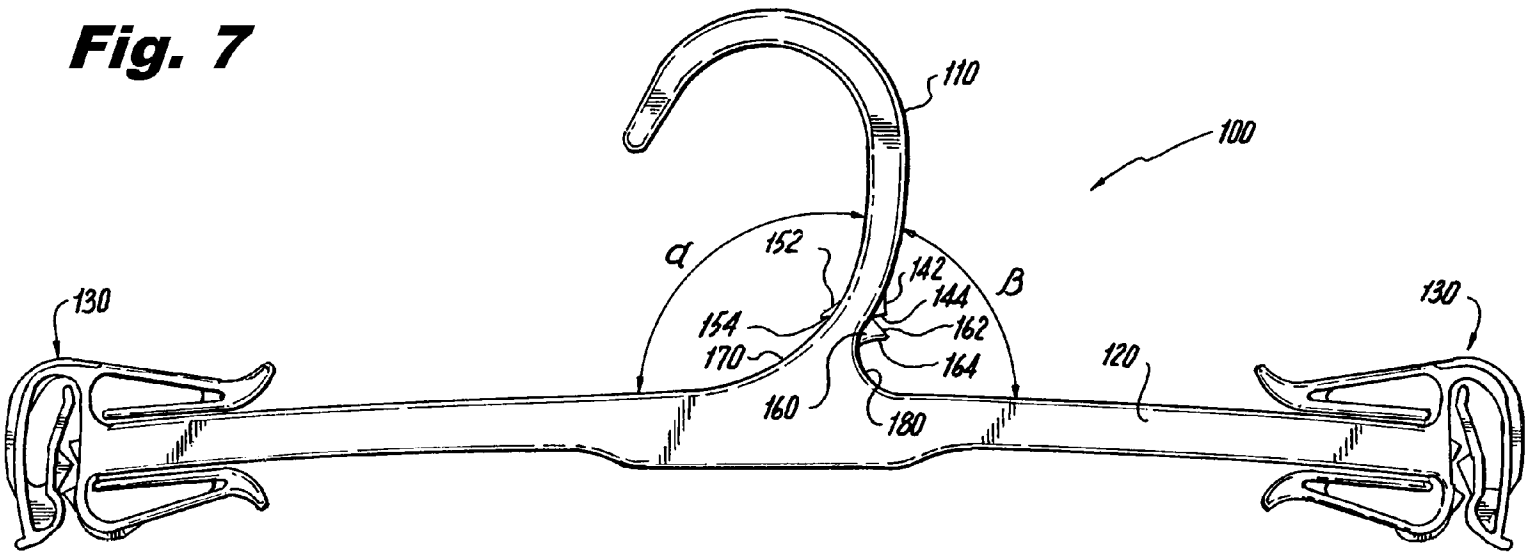
FIG. 9 is an isolated front elevation view of the hanger shown in FIG. 1.

FIG. 9 illustrates an isolated front view of the hanger 100. Preferably, the hanger hook 110 is integrally molded with the hanger body 120, to provide an obtuse angle $\alpha$ at one side of the hook 110 and an acute angle $\beta$ at the other side of the hook 110. A first curve 170 is formed at one side of the hook 110 corresponding to the angle $\alpha$ and a second curve 180 is formed at the other side of the hook 110 corresponding to the angle $\beta$, at the lower neck region A, to provide smooth transitions between the hook 110 and hanger body 120.

Preferably, the first curve 170 is configured and dimensioned to cooperate with the third flange 160 to prevent the movement of the indicator 200 horizontally along the Y direction. More preferably, the first curve 170 is configured to be complementary to an interior of the indicator 200, specifically the inner side of the second resilient tab 282, such that the second resilient tab 282 substantially rests on the second curve 170 once the indicator 200 sits on the hanger body 120. Thus, the first curve 170 and the third flange 160, in combination, provide a mating structure enclosed by the indicator 200. The mating structure is dimensioned to be substantially complementary to the upper inner profile of the indicator 200 along the horizontal direction, defined by the first resilient tab 262 and the second resilient tab 282.

According to the present invention, due to the provision of the first flange 140 and the opposite second flange 150, the resilient tabs 262 and 282 of the indicator 200 are displaced outwardly to allow a user to easily and quickly mount the indicator 200 onto the hanger 100.

Due to the retaining undersurfaces of the first flange 140 and the second flange 150, the movement of the indicator 200 upwardly along Z direction is prevented. Furthermore, by setting the first height H1 of the indicator 200 substantially equal to the second height H2 of the hanger 100, the indicator 200 is substantially pinched by the flanges 140 and 150 and the hanger body 120. Accordingly, the indicator 200 is not movable along the Z direction.

The provision of the third flange 160, preferably in cooperation with the curved 170 at the intersection of the hook 110 and the hanger body 120, prevents the indicator 200 from moving horizontally along the Y direction.

In addition, the provision of the first notch 268 and the second notch 288 between the anterior side wall 220 and the posterior side wall 240, the width W2 of which are substantially equal to the width W1 of the hanger body 120, ensures that indicator 200 does not move laterally along the X direction.

Accordingly, the accidental and unintentional separation of the indicator 200 from the hanger 100 can be effectively avoided. The hanger and indicator combination according to the present invention is "Child Proof".

Furthermore, as is understood by a person of ordinary skill in the art, although the invention has been described and depicted by an intimate apparel hanger as an exemplary embodiment, the invention is not limited to the combination of an intimate apparel hanger and an indicator. But rather, without departing from the scope of the present invention, the present invention can be applied to any other type of hanger, including but not limited to, top garment hangers, pinch grip hangers, knit wear hangers, swim wear hangers, children's hangers, coordinate hangers, and so on. Specifically, as described and depicted herein, the lower neck indicator having a resilient tab, can be attached to any one of the foregoing hangers, which is provided with a complementary flange extending from the hook of the hanger to operatively engage the resilient tab so as to retain the indicator at the lower neck region of the hanger. Preferably, as described and depicted herein, the hanger flange includes a sloped surface for enlarging a top opening of the indicator to allow the indicator to pass over the hook, and an undersurface for retaining the indicator at the lower neck region of the hanger. Preferably, as described and depicted herein, the indicator further includes a secondary resilient tab and the hanger further includes a secondary complementary flange for engaging the secondary resilient tab. More preferably, the secondary resilient tab includes a sloped surface for enlarging a top opening of the indicator to allow the indicator to pass over the hook, and an undersurface for retaining the indicator at the lower neck region of the hanger. The first flange and the second flange, in concert with each other, prevent the indicator from moving vertically. Preferably, the hanger further includes a third complementary flange, as described and depicted herein, which is substantially enclosed by the indicator once the indicator sits on the hanger body. The third flange has an outer profile substantially engaging an interior of the indicator. Preferably, as described and depicted herein, the hanger has a curvature at the lower neck region thereof, opposite to the third flange. The third flange and the curvature, in concert with each other, prevent the indicator from moving horizontally. Further, the indicator preferably includes a pair of notches formed at the lower ends of the indicator, as described and depicted herein. By means of the notches, the indicator straddles laterally on the hanger body once the indicator sits on the hanger body, as described and depicted herein. The straddling configuration prevents the indicator from moving laterally.

The plastic hanger of the present invention can be formed of styrene, which provides a clear, virtually transparent hanger for maximum display of intimate apparel garments, such as bras and panties, to be suspended therefrom. In the alternative, the hanger can be molded from polypropylene, preferably H.I. styrene polypropylene, polyvinylchloride, ABS or other suitable thermoplastics and mixtures thereof. For additional reinforcement, K resin can be added to the plastic material.

From the foregoing illustrations it is readily apparent that the present invention is directed to an improved hanger and indicator combination suitable for industry mass production. The combination of the present invention offers reliable fixation between the hanger and the indicator, satisfying industry standards, such as, the VICS standards.

The present invention has been described with respect to certain exemplary embodiments. Certain alterations and/or modifications will be apparent to those skilled in the art, in light of the instant disclosure, without departing from the spirit or the scope of the invention. These embodiments are offered as merely illustrative, and not limiting, on the scope of the invention, which is defined solely with reference to the following appended claims.

I claim:

1. A combination, comprising:

a hanger, comprising a hanger body and a hook extending upward from the body, the intersection of the hook and the hanger body defining a lower neck region of the hanger, the hanger further comprising at least a first flange projecting from the hook at a position distanced upward from the body of the hanger, the first flange having a first sloped surface extending downward and away from the hook and a first undersurface extending away from the hook; and an indicator for displaying information, the indicator positioned at the lower neck region below the first undersurface of the first flange, the indicator comprising an indicator body substantially surrounding the hook, the indicator further comprising a top opening and a bottom opening defined at the top side and bottom side of the indicator, respectively, the indicator further comprising at least a first resilient tab formed in the indicator body, wherein the first undersurface of the first flange provides indicator-retaining interference with the indicator to retain the indicator at the lower neck region, and wherein the hanger further comprises a lower flange disposed below the first flange and enclosed by the body of the indicator once the indicator passes over the first flange, the lower flange having a lower sloped surface adapted to engage an inner surface of the first resilient tab, thereby stabilizing the indicator on the hanger body.

2. The combination of claim 1, wherein the indicator body comprises a pair of opposing side walls connected by a pair of opposing end walls to provide a substantially trapezoidal profile of the indicator.

3. The combination of claim 2, wherein the first resilient tab is formed at the upper side of either a side wall or an end wall, the first resilient tab defined by a first pair of slots substantially bounding the sides of the first tab.

4. The combination of claim 3, wherein the first resilient tab comprises a first free upper end configured to engage the first sloped surface of the first flange to enlarge the top opening of the indicator to allow the indicator to pass over the first flange, the first free upper end also configured to engage the first undersurface of the first flange once the indicator passes over the first flange to retain the indicator at the lower neck region of the hanger.

5. The combination of claim 4, wherein the first undersurface of the first flange is substantially horizontal.

6. The combination of claim 5, wherein the indicator further comprises a first horizontal lip extending inwardly from the first resilient tab at the first free upper end, the first lip configured to engage the first sloped surface of the first flange to enlarge the top opening of the indicator to allow the indicator to pass over the first flange and to engage the first undersurface of the first flange once the indicator passed over the first flange to retain the indicator at the lower neck region of the hanger.

7. The combination of claim 6, wherein the hanger further comprises a second flange projecting from the hook at a position distanced upward from the body of the hanger and opposite to the first flange, the second flange having a second sloped surface extending downward and away from the hook and a second undersurface extending away from the hook.

8. The combination of claim 7, wherein the indicator further comprises a second resilient tab opposite to the first resilient tab, the second resilient tab formed at the upper side of either a side wall or an end wall opposite to the first resilient tab, the second resilient tab defined by a second pair of slots substantially bounding the sides of the second tab.

9. The combination of claim 8, wherein the second resilient tab comprises a second free upper end configured to engage the second sloped surface of the second flange to enlarge the top opening of the indicator to allow the indicator to pass over the second flange, the second free upper end also configured to engage the second undersurface of the second flange once the indicator passes over the second flange to retain the indicator at the lower neck region of the hanger.

10. The combination of claim 9, wherein the second undersurface of the second flange is substantially horizontal.

11. The combination of claim 10, wherein the indicator further comprises a second horizontal lip extending inwardly from the second resilient tab at the second free upper end, the second lip configured to engage the second sloped surface of the second flange to enlarge the top opening of the indicator to allow the indicator to pass over the second flange and to engage the second undersurface of the second flange once the indicator passed over the second flange to retain the indicator at the lower neck region of the hanger.

12. The combination of claim 2, further comprising a pair of notches formed at the lower ends of the end walls, respectively, the notches dimensioned to be substantially complementary to the width of the hanger body to at least partially accommodate the hanger body, thereby preventing the indicator from moving laterally.

13. The combination of claim 1, wherein the first flange, the hook and the hanger body are integrally molded.

14. The combination of claim 13, wherein the hook and the hanger body form an acute angle at one side of the hook and an obtuse angle at the other side of the hook.

15. The combination of claim 1, wherein the hanger body comprises a first arm extending from the hook to a first end of the hanger body and a second arm extending oppositely from the hook to a second end of the hanger body, and the hanger further comprises at least a first garment clip disposed at the first end of the hanger body and a second garment clip disposed at the second end of the hanger body.

16. The combination of claim 15, wherein the first garment clip and the second garment clip each comprise a vertical garment retaining clip, a lower horizontal garment retaining clip and an upper horizontal garment retaining clip.

* * * * *